United States Patent [19]

Kowalczyk

[11] Patent Number: 4,501,706

[45] Date of Patent: Feb. 26, 1985

[54] CARBURETOR AND SYSTEM FOR UTILIZING SAME

[76] Inventor: Thaddeus Kowalczyk, 8163 Lochdale, Dearborn Heights, Mich. 48127

[21] Appl. No.: 631,056

[22] Filed: Jul. 16, 1984

Related U.S. Application Data

[63] Continuation-in-part of Ser. No. 526,628, Aug. 29, 1983, , and a continuation-in-part of Ser. No. 602,716, Apr. 23, 1984.

[51] Int. Cl.[3] ..... F02M 23/02

[52] U.S. Cl. ..... 261/50 R; 261/78 R; 261/DIG. 51

[58] Field of Search ..... 261/50 R, 78 R, DIG. 51

[56] References Cited

U.S. PATENT DOCUMENTS

| | | | |
|---|---|---|---|
| 1,886,989 | 11/1932 | Trumble | 261/DIG. 51 |
| 1,897,967 | 2/1933 | Bruckner | 261/DIG. 51 |
| 2,012,564 | 8/1935 | Holmes | 261/DIG. 51 |
| 2,247,189 | 6/1941 | De Guyon | 261/DIG. 51 |
| 2,802,651 | 8/1957 | Creech | 261/50 R |
| 3,003,755 | 10/1961 | Peras | 261/78 R |
| 3,130,247 | 4/1964 | Little | 261/50 R |
| 4,162,281 | 7/1979 | Ingraham | 261/30 |

FOREIGN PATENT DOCUMENTS

| | | | |
|---|---|---|---|
| 143913 | 12/1935 | Fed. Rep. of Germany | 261/78 R |
| 1187065 | 2/1965 | Fed. Rep. of Germany | 261/50 R |
| 682576 | 11/1952 | United Kingdom | 261/78 R |

*Primary Examiner*—Tim Miles

*Attorney, Agent, or Firm*—Brooks & Kushman

[57] ABSTRACT

A carburetor including a housing having a plate with a plurality of vaporizers formed therein is disclosed. The vaporizers communicate air and fuel inlets formed in the housing with a mixing chamber which forms part of a central aperture which extends between the top and bottom surfaces of the housing. Each vaporizer includes a central fuel outlet opening into the mixing chamber transverse the central aperture and a plurality of inclined air outlets spaced about the fuel outlet for directing pressurized air against pressurized fuel in the fuel outlet to vaporize the fuel and also to force the vaporized fuel into the mixing chamber for mixing with air allowed therein from the top surface of the housing by a control mechanism. The vaporized fuel and air mixture thereafter freely flows from the mixing chamber and out of the housing at its bottom surface. A regulating mechanism including valves is disposed within the housing for controlling the flow of pressurized air and pressurized fuel therein to the vaporizers.

7 Claims, 7 Drawing Figures

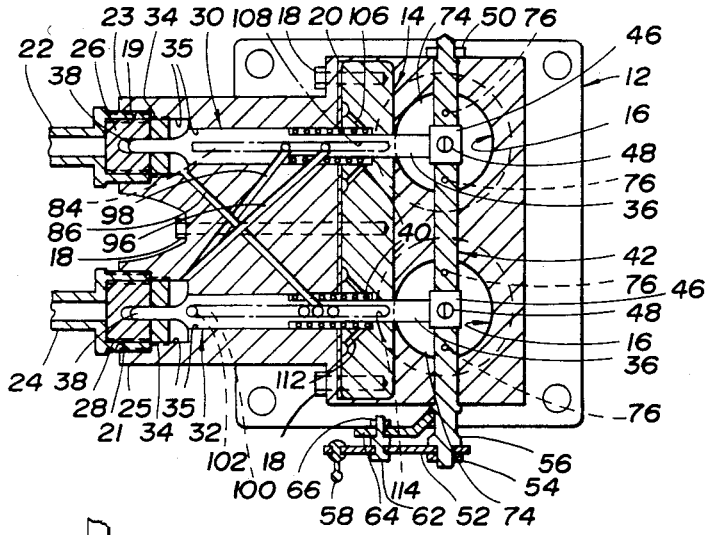
Fig. 4
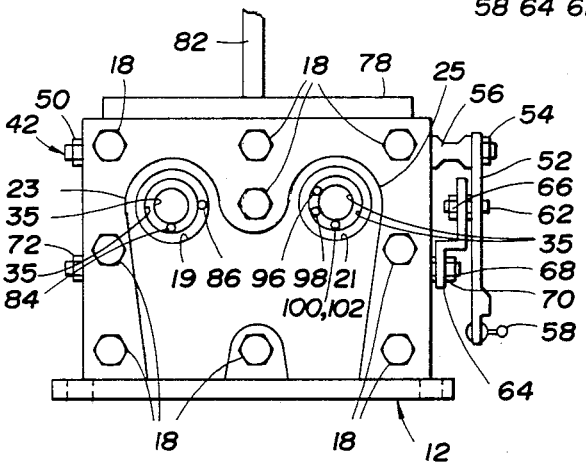
Fig. 5
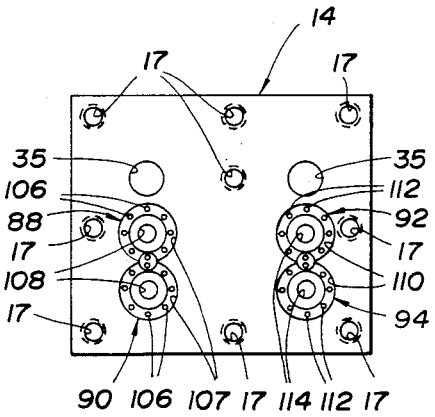
Fig. 6
Fig. 7
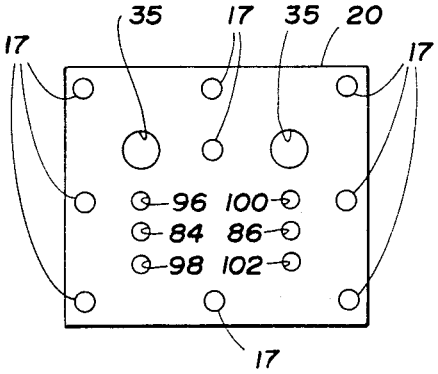

CARBURETOR AND SYSTEM FOR UTILIZING SAME

This is a continuation-in-part of application Ser. No. 526,628 filed Aug. 29, 1983, and a continuation-in-part of application Ser. No. 602,716 filed Apr. 23, 1984.

TECHNICAL FIELD

This invention relates to carburetors and systems which utilize such carburetors and, in particular, to carburetors in which pressurized fluid is vaporized by pressurized air.

BACKGROUND ART

Ever since the various oil shortages of the 1970's many projects to try to reduce the amount of fuel used by automotive vehicles have been initiated. In the same basic time frame concern over automotive air pollution also increased. One way of reducing fuel consumption and air pollution is to ensure that the fuel is completely burned in the car's engine. One method is to atomize or break apart the liquid fuel so that the car engine is better able to burn the resulting air-fuel mixture.

Numerous prior art patents disclose apparatus for atomizing fuel in a carburetor. For example, the U.S. Pat. No. 4,162,281 to Ingraham discloses an apparatus for feeding compressed air to an automobile carburetor for subsequent atomization therein.

Similarly, the patents to Trumble U.S. Pat. No. 1,886,989, Bruckner U.S. Pat. No. 1,897,967, Holmes U.S. Pat. No. 2,012,564 and De Guyon U.S. Pat. No. 2,247,189 all disclose various types of fuel vaporization devices.

There are numerous deficiencies of the prior art including the complexity and cost of the prior art apparatus. Also, such apparatus typically includes various moving and/or non-moving parts which are located between the vaporized fuel and the outlet of the carburetor, thereby causing a relatively large percentage of the vaporized fuel to form larger droplets. In other words, the carburetor itself causes the vaporized fuel to liquify before entering the engine.

DISCLOSURE OF THE INVENTION

An object of the present invention is to provide a relatively simple and low cost carburetor and system utilizing same.

Still another object of the present invention is to provide a carburetor and system for utilizing same which efficiently vaporizes liquid fuel, mixes the vaporized fuel with a controlled amount of air and delivers the resulting mixture to an engine without an appreciable amount of formation of larger droplets and, consequently, the carburetor is more efficient in making and keeping the fuel in vapor form for use by the engine.

In carrying out the above objects and other objects of the present invention, an apparatus for supplying an internal combustion engine with vaporized fuel mixed with air in an explosive mixture comprises a housing having at least one central aperture including a mixing chamber. The aperture extends completely through the housing between the top and bottom surfaces thereof. The housing also has a fuel inlet for receiving pressurized fuel and an air inlet for receiving pressurized air. Regulating means are disposed within the housing for controlling the flow of pressurized air and fuel therein. A control means is disposed in the housing for controlling the flow of air into the mixing chamber from the top surface of the housing. The housing also includes a plate having an outer face defining a side wall of the mixing chamber and has at least one vaporizer communicating the air and fuel inlets with the mixing chamber. The vaporizer includes a central fuel outlet opening into the mixing chamber transverse the central aperture and a plurality of inclined air outlets spaced about the fuel outlet for directing the vaporized air against the fuel in the fuel outlet to vaporize the fuel and to force the vaporized fuel into the mixing chamber for mixing with air allowed therein from the top surface by the control means. The vaporized fuel and air mixture are thereafter allowed to freely flow from the mixing chamber out of the housing at the bottom surface.

A system for supplying an internal combustion engine with vaporized fuel mixed with air in an explosive mixture includes the above-noted apparatus and also includes means for pressurizing the liquid fuel and means for pressurizing the air.

Preferably the plate includes a pair of spaced holes extending completely therethrough for slidably receiving a pair of valves of the regulating means. The regulating means also preferably includes a common control shaft rotatably mounted in the housing and operatively connected to the valves. The valves slide between the regulating positions upon rotation of the control shaft. The plate also preferably includes at least one pair of vaporizers and an inner face having a pair of intersecting circular grooves for distributing air from the air inlet to the air outlets about each fuel outlet.

The objects, features and advantages of the present invention are readily apparent from the following detailed description of the best mode for carrying out the invention when taken in connection with the accompanying drawings.

BRIEF DESCRIPTION OF THE DRAWINGS

FIG. 4 is a top view of the carburetor, partially broken away and in cross-section;

FIG. 5 is a front elevational view of the carburetor with the air and fuel connectors, filters and valve mechanisms removed;

FIG. 6 is a front elevational view of a housing plate, having vaporizers constructed in accordance with the present invention; and FIG. 7 is a front elevational view of a gasket having the various apertures formed therethrough and which is disposed between the housing plate and the remainder of the carburetor housing.

BEST MODE FOR CARRYING OUT THE INVENTION

Figure 1:
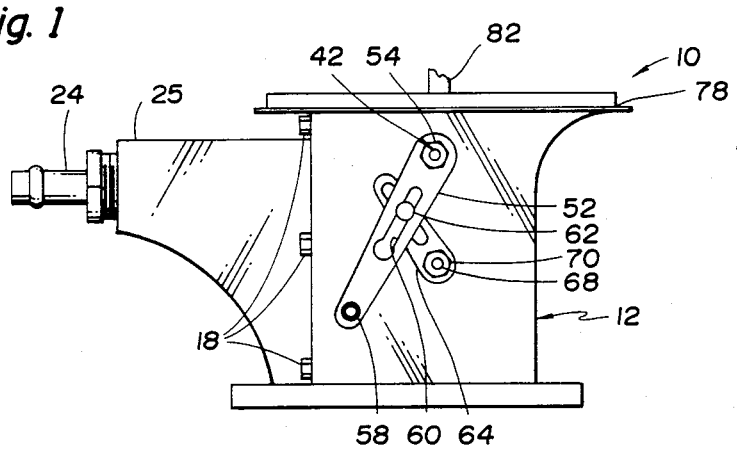
FIG. 1 is a side elevational view of a carburetor of the present invention.
Figure 2:
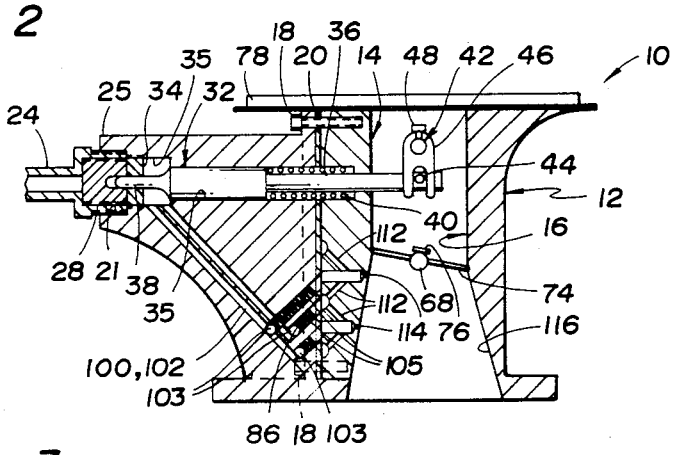
FIG. 2 is a side view, partially broken away and in cross-section of the carburetor.

Referring now to the drawings, there is illustrated generally at 10, a carburetor constructed in accordance with the present invention. The carburetor includes a housing including a main housing part 12 and a rectangular plate 14 which together define a pair of internal central apertures 16 of the housing. The plate 14 is secured to the housing part 12 by a plurality of mounting bolts 18 which extend through threaded holes 17 formed therein. An apertured gasket 20 is provided between the plate 14 and the main housing part 12 to insure that the joint between the two parts if fluid tight.

Figure 3:
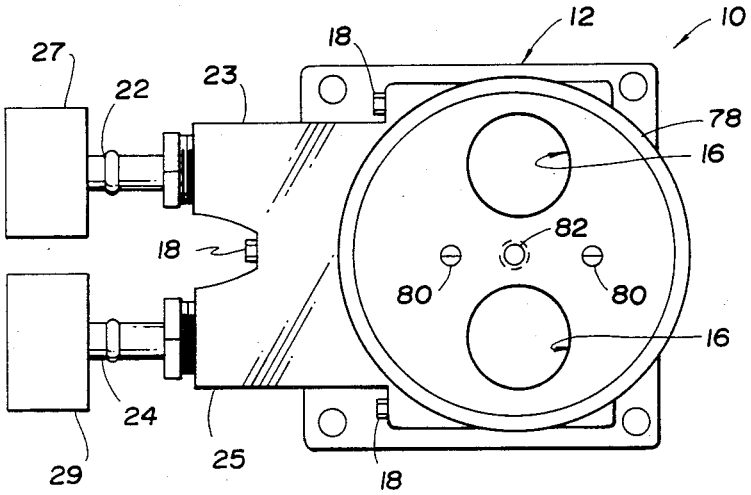
FIG. 3 is a top plan view of a system including the carburetor of the present invention with the various control and regulating mechanisms removed.

The main housing part 12 includes an intake air line connector 22 and an intake fuel line connector 24 for receiving pressurized air and pressurized fuel from conventional pressurized air and fuel sources illustrated schematically at 27 and 29, respectively, in FIG. 3. The pressurized air is preferably heated in the air source 27. The air and fuel line connectors 22 and 24 are threadedly mounted in bores 19 and 21 formed in projections 23 and 25, respectively, of the main housing part 12.

An air filter 26 is disposed within an enlarged portion of the air line connector 22 and a fuel filter 28 is disposed within an enlarged portion of the fuel line connector 24.

The flow of air and fuel through the connectors 22 and 24, respectively, is regulated by substantially identical valve mechanisms, generally indicated at 30 and 32, respectively. Each valve mechanism includes a jet or orificed ring 34 which is also threadedly mounted within an enlarged portion of a bore 35 of its respective projection 23 or 25. Each valve mechanism also includes a shaft, generally indicated at 36 which is slidably mounted in a reduced portion of the bore 35. The shaft 36 includes a plunger portion 38 integrally formed at one end thereof and which is slidably received within the aperture of the ring 34 to selectively permit or prevent the flow of air or fuel therethrough. Each shaft 36 is biased by a spring 40, which urges its respective plunger portion 38 toward its apertured ring 34.

The ends of the shafts 36 opposite the plunger portions 38 are connected by threaded pins 44 to a common control shaft 42 which, in turn, is rotatably mounted in the main housing part 12. Counter-clockwise rotation of the central shaft 42 causes the plunger portions of the shafts 36 to move out of their respective rings 34 against the biasing action of the springs 40. The threaded pins 44 are positioned between forks 46 which are fixedly mounted on the control shaft 42 by screws 48 at spaced locations to rotate therewith.

The control shaft 42 is rotatably mounted on the main housing part 12 at one end thereof by a nut 50 and fixedly mounted to one end of a control link 52 by a nut 54. The control link 52 is spaced from the main housing part 12 by a spacer portion 56 of the control shaft 42. The opposite end of the control link 52 has attached thereto a ball pin 58 to which an accelerator cable (not shown) may be secured for controlling the actuation of the control link 52 and thereby the valve mechanisms 30 and 32.

The control link 52 includes an elongated slot 60 in which is slidably received a sliding part 62 which, in turn, is fixedly secured to a second control link 64 by a nut 66. One end of the second control link 64 is fixedly secured to one end of an idle shaft 68 by a nut 70 to rotate therewith. The idle shaft 68 is rotatably mounted on the main housing part 12 and is secured thereto by a nut 72 in the same fashion as the control shaft 42 is rotatably secured on the main housing part 12.

Throttle plates 74 are fixedly mounted on the idler shaft 68 at spaced locations corresponding to the central apertures 16 by mounting screws 76, two of which are provided for each throttle plate 74. At the top surface of the main housing part 12 a support plate 78 for an air filter (not shown) is fixedly mounted to the housing by screws 80. The support plate includes a threaded bolt 82 which extend upwardly therefrom to provide an attachment location for a top plate (not shown) for securing the air filter thereto.

Referring again to the flow of pressurized air into the air connector 22, after the valve mechanism 30 has opened the pressurized air flows through air passages 84 and 86 which are formed in the main housing part 12 and which extend through the gasket 20 to the plate 14 as shown in FIG. 7. The air passage 84 feeds pressurized air to a pair of adjoining vaporizers, generally indicated at 88 and 90 formed in the plate 14. The air passage 86 feeds pressurized air to a pair of adjoining vaporizers, generally indicated at 92 and 94, and also formed in the plate 14.

In like fashion, when the valve mechanism 32 for the pressurized fuel opens, the pressurized fuel flows through fuel passages 96, 98, 100 and 102. The fuel passages 96 and 98 feed fuel to the vaporizers 88 and 90 and the fuel passages 100 and 102 feed fuel to the vaporizers 92 and 94.

The pair of vaporizers 88 and 90 include a pair of circular, intersecting grooves 107 formed in the inner face of the plate 14 so that only a single air passage such as air passage 84 is required to provide air for the two vaporizers 88 and 90. The pressurized air is distributed by the grooves 107 to a plurality of circumferentially spaced, inclined air outlets 106 which extend from the grooves 107 to a central fuel outlet 108 which is formed completely therethrough between the inner and outer faces of the plate 14.

In like fashion, the vaporizers 92 and 94 include a pair of intersecting circular grooves 110 which distribute air to air outlets 112 circumferentially distributed about central fuel outlets 114. The fuel outlets 114 are also formed completely through the plate 14 between the inner and outer faces of the plates 14 as best shown in FIG. 6.

The pressurized air flowing in the air outlets 106 and 112 atomizes or breaks apart the pressurized fuel flowing in the fuel outlets 108 and 114, respectively. The pressurized air also forces the vaporized fuel into their respective mixing chambers 116 for mixing with air allowed into the mixing chambers 116 by the throttle plates 74. The resulting mixture is thereafter allowed to freely flow downwardly without encountering any obstruction in the central apertures 16 to be received by the engine located therebelow (not shown).

Ball bearings 103 and respective biasing springs 105 are preferably provided in upwardly extending portions of the air passages 84 and 86 and the fuel passages 96 through 102 within the main housing part 12. The bearings 103 and the springs 105 serve as one-way valves to allow the flow of air and fuel to flow towards the plate 14, respectively, while preventing back pressure. Also, the liquid fuel is thereby maintained in the fuel passages 96 through 102 when the engine is turned off.

There are many advantages in the carburetor and system which utilizes the carburetor as constructed above. For example, the fuel is vaporized before being introduced into the mixing chamber. As a consequence, the vaporized fuel is subsequently more equally distributed to each of the cylinders in the internal combustion engine. In other words, the specific construction for forming the fine vapor allows for a more equal distribution and delivery of the resulting mixture to the cylinders of the internal combustion engine. Because of this, the mixture is burnt more evenly at the lowest motor speed, thereby giving the motor a longer life while at the same time conserving fuel. With the present construction there is a relatively small amount of fuel present in the carburetor at any one time, thereby making the carburetor relatively safer to use. Also, the above construction is simpler than the prior art carburetors and the carburetor is easier and cheaper to produce.

While the best mode for carrying out the invention has been described in detail, those familiar with the art to which this invention relates will recognize alternative ways of practicing the invention as defined by the following claims.

What is claimed is:

1. An apparatus for supplying an internal combustion engine with vaporized fuel mixed with air in an explosive mixture, the apparatus comprising:

a housing having at least one central aperture including a mixing chamber, the aperture extending completely through the housing between top and bottom surfaces thereof, the housing also having a fuel inlet for receiving pressurized fuel and an air inlet for receiving pressurized air;

regulating means disposed within said housing for controlling the flow of pressurized air and fuel therein; and control means disposed in said housing for controlling the flow of air into said mixing chamber from the top surface of said housing; said housing including a plate having an outer face defining a side wall of said mixing chamber and having at least one vaporizer communicating the air and fuel inlets with the mixing chamber, said vaporizer including a central fuel outlet opening into the mixing chamber transverse the central aperture and a plurality of inclined air outlets spaced about the fuel outlet for directing the pressurized air against the fuel in the fuel outlet to vaporize the fuel and to force the vaporized fuel into the mixing chamber for mixing with air allowed therein from the top surface by said control means, the vaporized fuel and air mixture thereafter freely flowing from the mixing chamber and out of said housing at its bottom surface.

2. A system for supplying an internal combustion engine with vaporized fuel mixed with air in an explosive mixture, the system comprising:

means for pressurizing a liquid fuel;

means for pressurizing air; and a carburetor including:

a housing having at least one central aperture including a mixing chamber, the central aperture extending completely through the housing between the top and bottom surfaces thereof, the housing also having a fuel inlet for receiving the pressurized fuel and an air inlet for receiving the pressurized air;

regulating means disposed within said housing for controlling the flow of pressurized air and fuel therein; and control means disposed in said housing for controlling the flow of air into said mixing chamber from the top surface of said housing; said housing including a plate having an outer face defining a side wall of said mixing chamber and having at least one vaporizer communicating the air and fuel inlets with the mixing chamber, said vaporizer including a central fuel outlet opening into the mixing chamber transverse the central aperture and a plurality of inclined air outlets spaced about the fuel outlet for directing the pressurized air against the fuel in the fuel outlet to vaporize the fuel and to force the vaporized fuel into the mixing chamber for mixing with air allowed therein from the top surface by said control means, the vaporized fuel and air mixture thereafter freely flowing from the mixing chamber and out of said housing at its bottom surface.

3. The invention as claimed in claim 1 wherein said plate includes a pair of spaced holes extending completely therethrough and wherein said regulating means includes a pair of valves slidably received within said holes.

4. The invention as claimed in claim 3 wherein said regulating means includes a common control shaft rotatably mounted in said housing and operatively connected to said valves, said valves sliding between regulating positions upon rotation of said control shaft.

5. The invention as claimed in claim 1 wherein said plate includes at least one pair of vaporizers and an inner face having a pair of intersecting circular grooves for distributing air from the air inlet to the air outlets about each fuel outlet.

6. The invention as claimed in claim 2 wherein said plate includes a pair of spaced holes extending completely therethrough and wherein said regulating means includes a pair of valves slidably received within said holes.

7. The invention as claimed in claim 2 wherein said plate includes at least one pair of vaporizers and an inner face having a pair of intersecting circular grooves for distributing air from the air inlet to the air outlets about each fuel outlet.

* * * * *